US009511490B2

(12) United States Patent
Ullrich et al.

(10) Patent No.: US 9,511,490 B2
(45) Date of Patent: Dec. 6, 2016

(54) HAND POWER TOOL DEVICE

(71) Applicant: Robert Bosch GmbH, Stuttgart (DE)

(72) Inventors: Andre Ullrich, Leinfelden-Echterdingen (DE); Holger Ruebsaamen, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 813 days.

(21) Appl. No.: 13/749,766

(22) Filed: Jan. 25, 2013

(65) Prior Publication Data

US 2013/0199815 A1 Aug. 8, 2013

(30) Foreign Application Priority Data

Feb. 3, 2012 (DE) ..... 10 2012 201 583

(51) Int. Cl.
*B25F 5/00* (2006.01)

(52) U.S. Cl.
CPC ..... *B25F 5/008* (2013.01); *Y10T 29/49826* (2015.01)

(58) Field of Classification Search
CPC ..... B25F 5/008; B23B 47/00; H02K 9/06
USPC ..... 173/213, 216, 217, 93.5, 93; 310/47, 50
See application file for complete search history.

(56) References Cited

U.S. PATENT DOCUMENTS 2,072,551 A * 3/1937 Forss ..... 173/217
3,511,322 A * 5/1970 Holman et al. ..... 173/75
3,824,745 A * 7/1974 Hutchins ..... 451/359
3,829,722 A * 8/1974 Rosenthal et al. ..... 310/50
4,921,375 A * 5/1990 Famulari ..... 408/67
6,105,450 A * 8/2000 Sasaki ..... B23Q 5/142 192/69.61
6,739,406 B2 * 5/2004 Lebisch et al. ..... 173/213
7,258,173 B2 * 8/2007 Hammerstingl et al. ..... 173/201
7,410,009 B2 * 8/2008 Hirayama et al. ..... 173/201
2007/0007026 A1 * 1/2007 Hofmann ..... 173/216
2008/0315693 A1 12/2008 Uchida
2009/0107691 A1 * 4/2009 Umeda ..... B25F 5/02 173/217
2010/0102654 A1 4/2010 Lange et al.
2011/0171887 A1 * 7/2011 Tanimoto et al. ..... 451/359
2012/0187782 A1 * 7/2012 Esenwein ..... 310/43

FOREIGN PATENT DOCUMENTS

JP 2007-7821 A 1/2007

* cited by examiner

*Primary Examiner* — Nathaniel Chukwurah

(74) *Attorney, Agent, or Firm* — Maginot, Moore & Beck LLP

(57) ABSTRACT

A hand power tool device includes at least one drive unit, which has at least one drive shaft. The hand power tool device also includes at least one transmission unit which has at least one transmission element that is directly connected to the drive shaft. The hand power tool device also includes at least one cooling unit which has a fan element. The fan element is at least substantially directly connected to the at least one transmission element of the at least one transmission unit.

12 Claims, 3 Drawing Sheets

HAND POWER TOOL DEVICE

This application claims priority under 35 U.S.C. §119 to patent application no. DE 10 2012 201 583.3, filed on Feb. 3, 2012 in Germany, the disclosure of which is incorporated herein by reference in its entirety.

BACKGROUND

There are already known hand power tool devices according to the description below.

The disclosure is based on a hand power tool device having at least one drive unit, which comprises at least one drive shaft, having at least one transmission unit comprising at least one transmission element that is directly connected to the drive shaft, and having at least one cooling unit, which comprises a fan element.

SUMMARY

It is proposed that the at least one fan element is at least substantially directly connected to the at least one transmission element of the at least one transmission unit. A "drive unit" in this context is to be understood to mean, in particular, a unit provided to generate a motion, preferably a rotational motion, in particular of the drive shaft. The drive unit preferably comprises a motor, particularly preferably an electric motor. Also conceivable, however, are other configurations of the drive unit that are considered appropriate by persons skilled in the art. In a preferred exemplary embodiment, the motion of the drive shaft is transferred to an insert tool, which is connected to a hand power tool comprising the hand power tool device. The term "provided" is to be understood to mean, in particular, specially configured and/or equipped. The term "at least substantially" is to be understood to mean, in particular, "at least partially", preferably "at least almost completely" and/or that a deviation from a predefined value deviates, in particular, by less than 25%, preferably less than 10%, and particularly preferably less than 5% from the predefined value. A "drive shaft" in this context is to be understood to be, in particular, an at least substantially rod-shaped element that is provided, at least substantially, to transmit a motion, in particular a rotational motion, and/or a moment, in particular a torque. In a particularly preferred exemplary embodiment, a motion and/or a moment of the drive shaft is transmitted when in an operating state, in particular via the transmission unit, to the insert tool, which is connected to a hand power tool comprising the hand power tool device. The transmission unit is preferably provided for altering the speed, the moment and/or the direction of motion. Particularly preferably, the transmission unit comprises at least one planetary gear set for altering, or adapting, the speed, in particular the rotational speed of the motor shaft. Also conceivable, however, are other configurations of the transmission unit that are considered appropriate by persons skilled in the art.

A "cooling unit" in this context is to be understood to mean, in particular, a unit provided, at least substantially, to cool the hand power tool device, in particular the drive unit, when in an operating state. For this purpose, the cooling unit preferably comprises the at least one fan element, which is provided to be driven, in particular rotationally, at least when the drive unit is in the operating state. As a result, a fluid flow can be generated to remove heat inside the hand power tool device, in particular inside the drive unit. Particularly preferably, the fan element, when in the operating state, generates an air flow, at least substantially. The fan element is preferably constituted by a fan impeller. Also conceivable, however, are other configurations of the cooler unit, or fan element, that are considered appropriate by persons skilled in the art.

The term "directly connected" is to be understood to mean, in particular, that the at least one fan element and the transmission element are in contact with each other and/or bear on each other in an at least substantially form-fitting manner over an axial extent of the fan element and/or the transmission element. In a particularly preferred exemplary embodiment, the at least one fan element and the transmission element are connected to each other while at least substantially avoiding other components, in particular other functional components. The term "connected" in this context is to be understood to mean, in particular, a connection produced, at least substantially, by a joining process between at least two, in particular separately produced components.

The configuration according to the disclosure makes it possible to achieve a preferably space-saving, compact and structurally small configuration of the hand power tool device, in particular in an axial direction. In particular, the cooling unit can be integrated into the hand power tool device in an advantageously compact manner, in particular without substantially increasing a structural length in the axial direction, in a structurally simple manner. In addition, advantageously, savings can be made in structural parts, and therefore in production costs and assembly work.

Further, it is proposed that the at least one transmission element is pressed on to the at least one drive shaft. The term "pressed on to" in this context is to be understood to mean, in particular, that the transmission element, before being assembled with the drive shaft, is oversized relative to the drive shaft, and that between the transmission element and the drive shaft, when in an assembled, or pressed-on state, there is, at least substantially, a force-fitting, in particular manually non-separable, fixed connection, which is configured, in particular, to be separable only by means of technical accessories and/or cooling or heating processes. In a particularly preferred exemplary embodiment, the transmission element, when being assembled, is pressed on to the drive shaft by means of a cold pressing method and/or oil pressing method or by means of a shrink-on and/or cold expansion method. Further, it is conceivable for the transmission element to be materially bonded to the drive shaft, in particular by means of an adhesive layer and/or a weld seam, and/or in a form-fitting manner, in particular by means of at least one form-fit element. Also conceivable, however, are other assembly configurations considered appropriate by persons skilled in the art. This makes it possible to achieve a preferably secure, structurally simple and advantageously inexpensive connection between the transmission element and the drive shaft.

Further, it is conceivable for the at least one fan element to be pressed on to the at least one transmission element. The term "pressed on to" in this context is to be understood to mean, in particular, that the fan element, before being assembled with the transmission element, is oversized relative to the transmission element, and that between the fan element and the transmission element, when in an assembled, or pressed-on state, there is, at least substantially, a force-fitting, in particular manually non-separable, fixed connection, which is configured, in particular, to be separable only by means of technical accessories and/or cooling or heating processes. In a particularly preferred exemplary embodiment, the fan element, when being assembled, is pressed on to the transmission element by means of a cold pressing method and/or oil pressing method or by means of a shrink-on and/or cold expansion method. Further, it is conceivable for the fan element to be materially bonded to the transmission element, in particular by means of an adhesive layer and/or a weld seam, and/or in a form-fitting manner, in particular by means of at least one form-fit element. Also conceivable, however, are other assembly configurations considered appropriate by persons skilled in the art. This makes it possible to achieve a preferably secure, structurally simple and advantageously inexpensive connection between the fan element and the transmission element.

Furthermore, it is proposed that the at least one transmission element has at least one toothing. Preferably, the transmission element constitutes, at least partially, a toothed wheel of the transmission unit. In a particularly preferred exemplary embodiment, the transmission element constitutes, at least partially, a sun wheel, in particular a transmission unit comprising a planetary gear set. This makes it possible to achieve an advantageously compact configuration of the hand power tool device.

Further, it is conceivable for the at least one transmission element to comprise at least one region provided with the toothing, at least partially, and to comprise at least one at least substantially cylindrical region. Preferably, the regions are realized so as to adjoin each other. This makes it possible to achieve a preferred multifunctionality of the at least one transmission element in a structurally simple manner.

In addition, it is proposed that the at least one fan element is disposed, at least partially, in the at least substantially cylindrical region. Preferably, the at least one fan element is at least substantially directly connected to the cylindrical region, or pressed on to the transmission element in the cylindrical region. This makes it possible to achieve an advantageously space-saving configuration of the hand power tool device in a structurally simple manner.

Furthermore, it is proposed that the at least one fan element is composed of a plastic, at least substantially. A "plastic" in this case is to be understood to mean, in particular, a material that is constituted by an organic polymer and that is composed, at least partially, of at least one, in particular synthetically produced, monomeric, organic substance. This makes it possible to achieve an advantageously light, inexpensive and robust configuration of the at least one fan element.

In addition, it is proposed that the at least one fan element has at least one stop element, which is provided, at least substantially, to prevent, at least substantially, a relative motion in an axial direction between the at least one fan element and the at least one transmission element. A "stop element" in this context is to be understood to mean, in particular, an element that is provided, at least substantially, when in an assembled state, to constitute a form-fit with at least one corresponding stop element and to prevent, at least substantially, a relative motion of the fan element, at least in an axial direction and/or in a circumferential direction and/or in a radial direction, in relation to the transmission element. This makes it possible to achieve an advantageously stable and secure connection between the at least one fan element and the at least one transmission element in a structurally simple manner.

BRIEF DESCRIPTION OF THE DRAWINGS

Further advantages are given by the following description of the drawing. The drawing shows three exemplary embodiments of the disclosure. The drawing and the description contain numerous features in combination. Persons skilled in the art will also expediently consider the features individually and combine them to create appropriate further combinations.

In the drawing.

DETAILED DESCRIPTION

Figure 1:
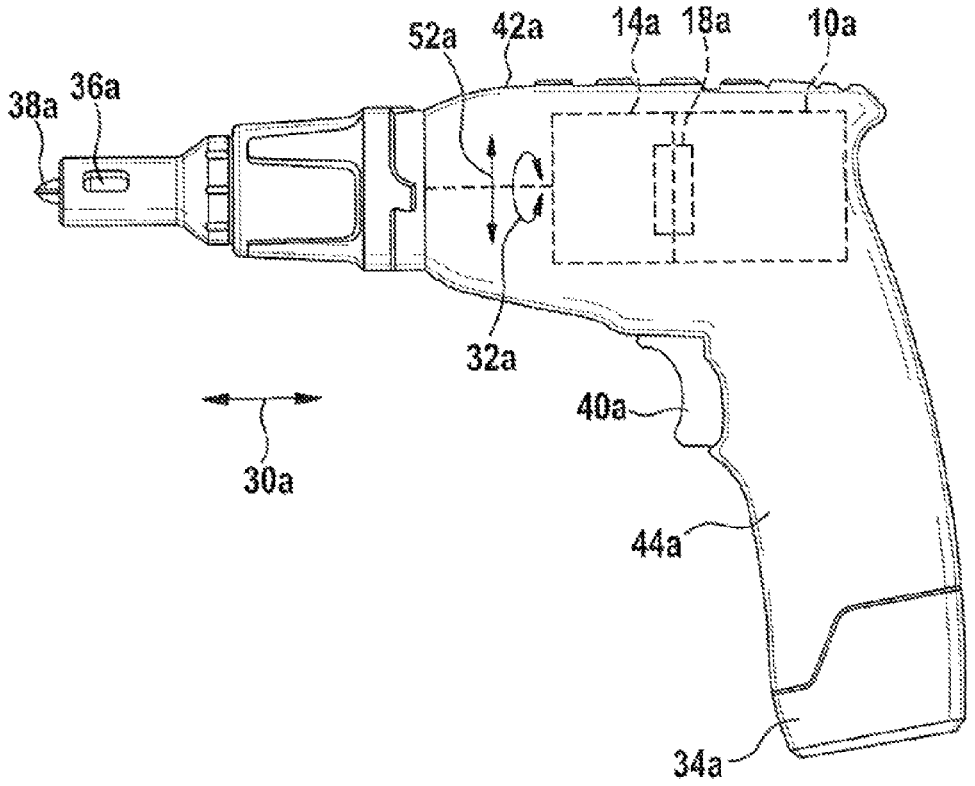
FIG. 1 shows a hand power tool according to the disclosure, in a schematic representation.

FIG. 1 shows a hand power tool, which has a battery 34*a* for supplying the hand power tool with an electrical voltage. The hand power tool is constituted by a drywall screwdriver. The hand power tool has a tool receiver 36*a*, which is provided to hold an insert tool 38*a* in a captive manner. The hand power tool additionally has a drive unit 10*a*, represented schematically. The drive unit 10*a* comprises a motor, not represented in greater detail. The motor is constituted by an electric motor. The drive unit 10*a* is provided to drive the insert tool 38*a* held in the tool receiver 36*a*. The insert tool 38*a* is driven in rotation. The hand power tool additionally has a transmission unit 14*a*, represented schematically. In addition, the hand power tool has a cooling unit 18*a*, represented schematically, which is provided to cool the drive unit 10*a* when in an operating state. The hand power tool has a control element 40*a*, by means of which the drive unit 10*a* can be activated by an operator of the hand power tool. The control element 40*a* is disposed in a region of a housing 42*a* of the hand power tool that constitutes a handle region 44*a*. The housing 42*a* of the hand power tool encloses the drive unit 10*a*, the cooling unit 18*a* and the transmission unit 14*a*.

Figure 2:
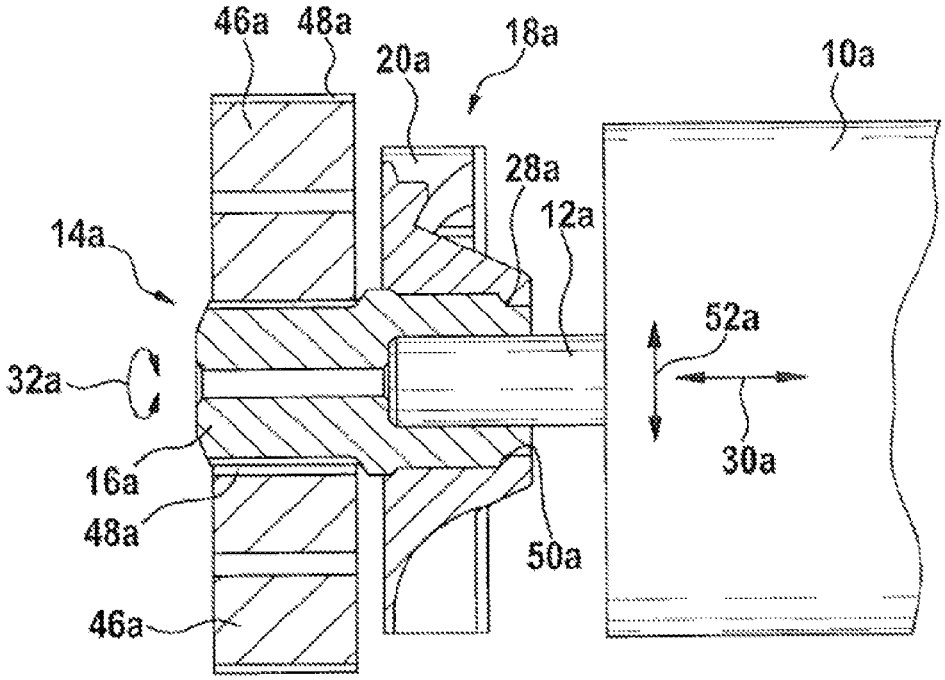
FIG. 2 shows a portion of a hand power tool device of the hand power tool, in a sectional representation.

The transmission unit 14*a* comprises a transmission element 16*a*, which has a toothing 22*a* (FIG. 2). The transmission unit 14*a* comprises a planetary gear set, known to persons skilled in the art. The transmission element 16*a* constitutes a sun wheel of the planetary gear set of the transmission unit 14*a*. The transmission element 16*a* realized as a sun wheel engages respectively, by the toothing 22*a*, in a toothing 48*a* of a transmission element 46*a* constituting a planet wheel. The transmission element 16*a* is made of a sintered material. The transmission unit 14*a* is operatively connected to the drive unit 10*a*. The drive unit 10*a* has a motor shaft 12*a*, to which the transmission element 16*a* is connected. The transmission element 16*a* is pressed on to the motor shaft 12*a* of the drive unit 10*a*. The transmission element 16*a* comprises a cylindrical region 26*a*, and comprises a region 24*a* in which the toothing 22*a* is disposed. The cylindrical region 26*a* and the region 24*a* in which the toothing 22*a* is disposed are realized separately from each other, and adjoin each other. The cylindrical region 26*a* constitutes a compression shoe. The transmission element 16*a* is pressed on to the motor shaft 12*a* of the drive unit 10*a* by means of the cylindrical region 26*a*.

Figure 3:
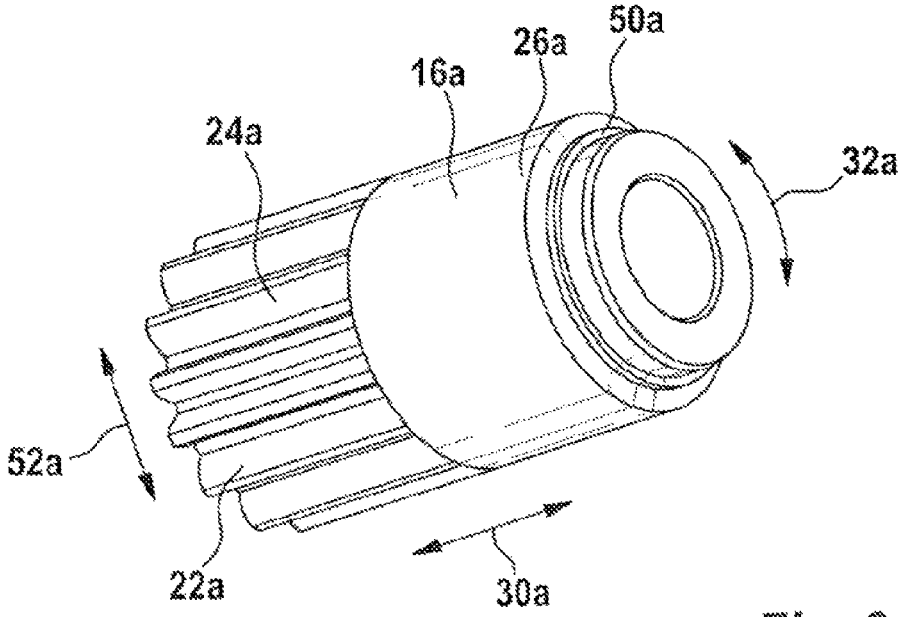
FIG. 3 shows the transmission element, in a perspective representation.

The cooling unit 18*a* has a fan element 20*a*. The fan element 20*a* is constituted by a fan impeller. The fan element 20*a* is composed of a plastic. The fan element 20*a* is realized so as to be fixedly and directly connected to the transmission element 16*a* of the transmission unit 14*a*. The fan element 20*a* is pressed on to the transmission element 16*a*. The fan element 20*a* is disposed in the cylindrical region 26*a* of the transmission element 16*a*. When in an operating state, a rotational speed of the motor shaft 12*a* of the drive unit 10*a* corresponds to a rotational speed of the transmission element 16*a* of the transmission unit 14*a* and to a rotational speed of the fan element 20*a* of the cooling unit 18*a*. The fan element 20*a* is provided for self-cooling of the drive unit 10*a*. The fan element 20*a* is composed of a plastic. The transmission element 16*a* has a stop element 50*a* at an end that faces away from the region 24*a* provided with the toothing 22*a*. The fan element 20*a* likewise has a stop element 28*a*, which is provided to correspond to the stop element 50*a* of the transmission element 16*a*. The stop elements 28*a*, 50*a* are provided, when in an assembled state, to prevent a relative motion in an axial direction 30*a* between the fan element 20*a* and the transmission element 16*a*. The stop element 50*a* of the transmission element 16*a* is constituted by an annular material recess of the cylindrical region 26*a* (FIG. 3). The stop element 28*a* of the fan element 20*a* is constituted by an annular projection, which extends inward in a radial direction 52*a*. When in an assembled state, the stop element 28*a* of the fan element 20*a* engages in the stop element 50*a* of the transmission element 16*a*, and prevents a relative motion of the fan element 20*a* in the axial direction 30*a* toward the region of the transmission element 16*a* in which the toothing 22*a* is disposed.

The descriptions that follow and the drawings of further exemplary embodiments are limited substantially to the differences between the exemplary embodiments and, in respect of components having the same designation, in particular with regard to components having the same references, reference may also be made in principle to the drawings and/or the description of the other exemplary embodiments. To distinguish the exemplary embodiments, instead of the letter a of the first exemplary embodiment, the references of the further exemplary embodiments have the suffix letters b and c.

Figure 4:
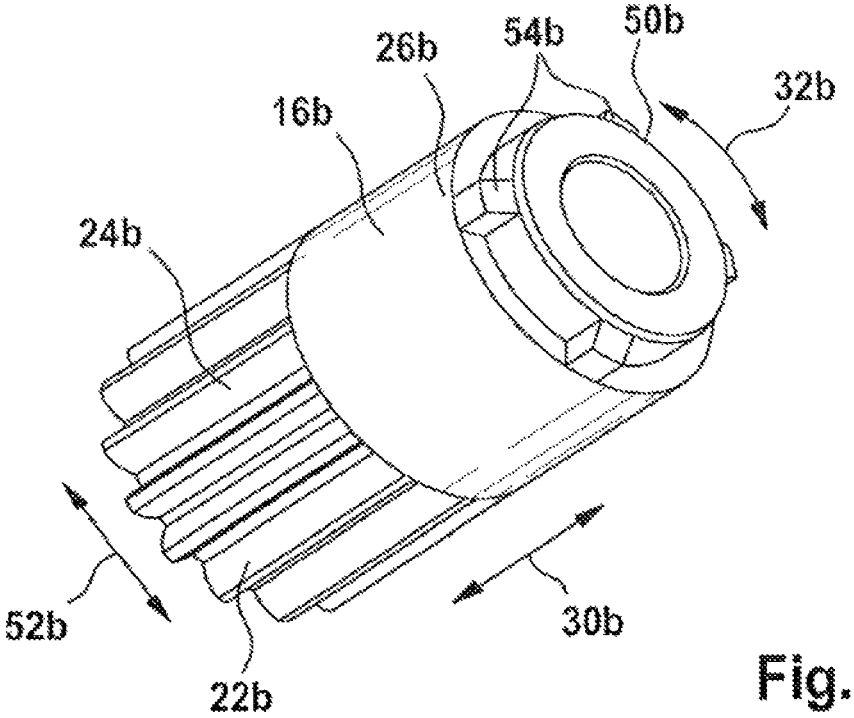
FIG. 4 shows an alternative configuration of the transmission element of the hand power tool device according to the disclosure, in a perspective representation.

FIG. 4 shows an alternatively configured transmission element 16*b* of a transmission unit 14*b* of a hand power tool. The transmission element 16*b* comprises a cylindrical region 26*b*, and comprises a region 24*b* in which a toothing 22*b* is disposed. The cylindrical region 26*b* and the region 24*b* in which the toothing 22*b* is disposed are realized separately from each other, and adjoin each other. The cylindrical region 26*b* constitutes a compression shoe. The transmission element 16*b* is provided to be pressed on to a motor shaft 12*b* of a drive unit 10*b*, by means of the cylindrical region 26*b* of the transmission element 16*b* that is realized as a compression shoe.

The transmission element 16*b* has a stop element 50*b* at an end that faces away from the region 24*b* provided with the toothing 22*b*. The stop element 50*b* of the transmission element 16*b* is constituted by an annular material recess of the cylindrical region 26*b*, and has a plurality of projections 54*b* uniformly distributed in a circumferential direction 32*b* of the transmission element 16*b*. A fan element of a cooling unit, not represented, which corresponds to the fan element 18*a* already described, has a stop element provided to correspond to the stop element 50*b* of the transmission element 16*b*. The stop element of the fan element is constituted by an annular projection, which extends inward in a radial direction 52*b* and which has a plurality of recesses corresponding to the projections 54*b*. The stop element 50*b* of the transmission element 16*b* and the stop element of the fan element are provided, when in an assembled state, to prevent a relative motion in an axial direction 30*b* and in a circumferential direction 32*b* between the fan element and the transmission element 16*b*. When in an assembled state, the stop element of the fan element engages in the stop element 50*b* of the transmission element 16*b*, and prevents a relative motion of the fan element in the axial direction 30*b* toward the region 24*b* of the transmission element 16*b* in which the toothing 22*b* is disposed.

Figure 5:
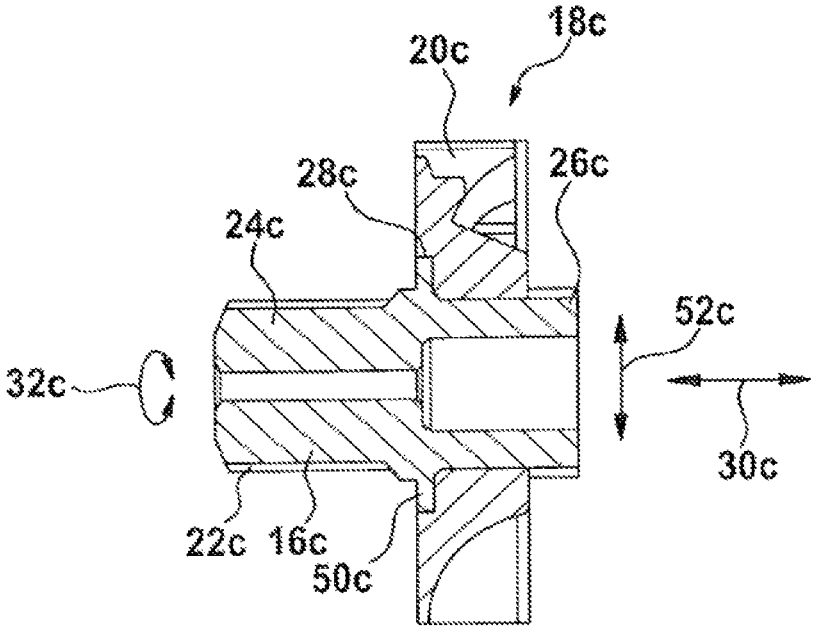
FIG. 5 shows a further, alternative configuration of the transmission element of the hand power tool device according to the disclosure with a fan element, in a perspective representation.

FIG. 5 shows an alternatively configured transmission element 16*c* of a transmission unit 14*c* of a hand power tool. The transmission element 16*c* comprises a cylindrical region 26*c*, and comprises a region in which the toothing is disposed. The cylindrical region and the region 24*c* in which a toothing 22*c* is disposed are realized separately from each other, and adjoin each other. The cylindrical region 26*c* constitutes a compression shoe. The transmission element 16*c* is provided to be pressed on to a motor shaft 12*c* of a drive unit 10*c*, by means of the cylindrical region 26*c* of the transmission element 16*c* that is realized as a compression shoe.

Between the region 24*c*, which is provided with the toothing 22*c*, and the cylindrical region 26*c*, the transmission element 16*c* has a stop element 50*c*. The stop element 50*c* of the transmission element 16*c* is constituted by an annular projection, which adjoins a surface of the transmission element 16*c* in a radial direction 52*c* and extends outward in the radial direction 52*c*. A fan element 20*c* of a cooling unit 18*c*, which corresponds to the fan element 18*a* already described, has a stop element 28*c*, which is provided to correspond to the stop element 50*c* of the transmission element 16*c*. The stop element 28*c* of the fan element 20*c* is constituted by an annular material recess, which extends into a material of the fan element 20*c* in the radial direction 52*c*. The stop elements 28*c*, 50*c* are provided, when in an assembled state, to prevent a relative motion in an axial direction 30*c* between the fan element 20*c* and the transmission element 16*c*. When in an assembled state, the stop element 28*c* of the fan element 20*c* engages in the stop element 50*c* of the transmission element 16*c*, and prevents a relative motion of the fan element 20*c* in the axial direction 30*c* toward the cylindrical region 26*c* of the transmission element 16*c*.

What is claimed is:

1. A hand power tool device comprising:

at least one drive unit including at least one drive shaft;

at least one transmission unit including at least one transmission element that is directly and fixedly connected to the at least one drive shaft; and at least one cooling unit including at least one fan element, wherein the at least one fan element is at least substantially directly connected to the at least one transmission element of the at least one transmission unit.

2. The hand power tool device according to claim 1, wherein the at least one transmission element is pressed on to the at least one drive shaft.

3. The hand power tool device according to claim 1, wherein the at least one fan element is pressed on to the at least one transmission element.

4. The hand power tool device according to claim 1, wherein the at least one transmission element has at least one toothing.

5. The hand power tool device according to claim 4, wherein:

the at least one transmission element includes at least one region which at least partially includes the at least one toothing, and the at least one transmission element includes at least one at least substantially cylindrical region.

6. The hand power tool device according to claim 5, wherein the at least one fan element is at least partially disposed in the at least one at least substantially cylindrical region.

7. The hand power tool device according to claim 1, wherein the at least one fan element is composed at least substantially of a plastic.

8. The hand power tool device according to claim 1, wherein the at least one fan element has at least one stop element at least substantially configured to at least substantially prevent a relative motion between the at least one fan element and the at least one transmission element in at least one of an axial direction and a circumferential direction.

9. A method for producing a hand power tool device comprising:

connecting a transmission element of a transmission unit directly to a drive shaft of a drive unit; and connecting a fan element of a cooling unit to the transmission element.

10. A hand power tool comprising:

a hand power tool device including:

at least one drive unit having at least one drive shaft;

at least one transmission unit having at least one transmission element that is directly connected to the at least one drive shaft; and at least one cooling unit having at least one fan element, wherein the at least one fan element is at least substantially directly connected to the at least one transmission element of the at least one transmission unit.

11. A hand power tool device comprising:

at least one drive unit including at least one drive shaft;

at least one transmission unit including at least one transmission element that is directly connected to the at least one drive shaft; and at least one cooling unit including at least one fan element, wherein the at least one fan element is at least substantially directly connected to the at least one transmission element of the at least one transmission unit, wherein the at least one transmission element is pressed on to the at least one drive shaft.

12. A hand power tool device comprising:

at least one drive unit including at least one drive shaft;

at least one transmission unit including at least one transmission element that is directly connected to the at least one drive shaft; and at least one cooling unit including at least one fan element, wherein the at least one fan element is at least substantially directly connected to the at least one transmission element of the at least one transmission unit, wherein the at least one fan element has at least one stop element at least substantially configured to at least substantially prevent a relative motion between the at least one fan element and the at least one transmission element in at least one of an axial direction and a circumferential direction.

* * * * *